US005944035A

United States Patent [19]

Chen

[11] Patent Number: 5,944,035

[45] Date of Patent: Aug. 31, 1999

[54] DETERGENT RECYCLING APPARATUS FOR PARTS WASHING MACHINE

[76] Inventor: I-Lung Chen, P.O. Box 82-144, Taipei, Taiwan

[21] Appl. No.: 09/139,392

[22] Filed: Aug. 25, 1998

[51] Int. Cl.[6] ..... B08B 3/02

[52] U.S. Cl. ..... 134/111; 134/167 R; 134/198; 134/201; 239/526

[58] Field of Search ..... 134/167 R, 168 R, 134/166 R, 198, 201, 111, 115; 15/320, 321; 239/146, 526

[56] References Cited

U.S. PATENT DOCUMENTS

| | | | |
|---|---|---|---|
| 3,591,889 | 7/1971 | Wisner | 15/321 |
| 3,896,521 | 7/1975 | Parise | 15/321 |
| 4,696,075 | 9/1987 | Grave | 15/321 |
| 5,078,799 | 1/1992 | Matter et al. | 134/167 R |
| 5,087,294 | 2/1992 | Rechtzigel | 134/167 R |
| 5,293,887 | 3/1994 | Thibodeaux | 134/167 R |
| 5,518,553 | 5/1996 | Moulder | 134/167 R |
| 5,657,782 | 8/1997 | Berning | 134/167 R |
| 5,740,821 | 4/1998 | Arnold | 134/167 R |
| 5,756,580 | 5/1998 | Dassi | 134/198 |

*Primary Examiner*—Frankie L. Stinson
*Attorney, Agent, or Firm*—A & J

[57] ABSTRACT

An improved detergent recycling apparatus for parts washing machines includes a detergent recycling apparatus additionally provided with a control box, a manifold, a first control valve, an extension tube, a spray gun, a second control valve, a third air duct and a secondary serpentine hose. The control box is mounted on one side of the detergent recycling apparatus, and the manifold, first control valve, silencer, extension tube and second control valve are assembled thereto. The manifold is internally provided with an air vent and has a high pressure air inlet at one end thereof. The manifold includes front, intermediate and rear threaded holes. The first control valve is screwably secured to the rear threaded hole and communicates with an extraction pump via a first air duct. The extension tube is screwably locked to the front threaded hole at one end and connected to the spray gun at the other. The second control valve is locked to the intermediate threaded hole and connected to the secondary serpentine hose via the third air duct. The secondary serpentine hose has a bent connector mounted at an outer side of the detergent recycling apparatus near a bottom portion thereof. High-pressure air enters via the high-pressure air inlet through the extension tube to the spray gun to blow off residual cleaning solution on the washed parts to achieve optimum washing effects. The second control valve controls another current of high pressure air via the third air duct and the secondary serpentine hose into the bottom portion of the oil tank so as to blow up the cleaning solution and iron filings and slurry deposited on the bottom portion of the oil tank to facilitate discharge thereof through a screw hole at the bottom portion of the oil tank.

1 Claim, 6 Drawing Sheets

DETERGENT RECYCLING APPARATUS FOR PARTS WASHING MACHINE

BACKGROUND OF THE INVENTION

1. Field of the Invention

The present invention relates generally to a detergent recycling apparatus, more particularly to an improved detergent recycling apparatus for parts washing machines.

2. Description of the Prior Art

A conventional detergent recycling apparatus 10 for parts washing machines is shown in FIG. 1 and essentially comprises a high pressure air inlet 11, a first air duct 12, an extraction pump 13, a second air duct 14, a silencer 15, a filter mesh 101, an oil duct 16, and a serpentine hose 17. The detergent recycling apparatus 10 is installed at an inner edge of an oil tank 20 and immersed in a cleaning solution. High-pressure air is induced via the high-pressure air inlet 11 and transported by the first air duct 12 to the extraction pump 13 to drive vacuum vanes therein to turn. The second air duct 14 draws air from the silencer 15 to be discharged. When the vacuum vanes in the extraction pump 13 rotates, a drawing force is generated to suck the cleaning solution through the filter mesh 101 and in via a suction port 131 of the extraction pump 13. The cleaning solution is then transported by the oil tube 16 to the serpentine hose 17 and flows out for washing impurities and oil stains on processed metal parts. Conventional detergent recycling apparatuses are mostly designed to wash impurities and oil stains off metal parts and do not have additional functions.

SUMMARY OF THE INVENTION

The present invention relates generally to a detergent recycling apparatus, more particularly to an improved detergent recycling apparatus for parts washing machines.

A primary object of the present invention is to provide an improved detergent recycling apparatus for parts washing machines in which high pressure air is induced via a high pressure air inlet past an extension tube to a spray gun to blow off residual cleaning solution on washed parts so as to achieve optimum washing effects.

Another object of the present invention is to provide an improved detergent recycling apparatus for parts washing machines in which a second control valve is provided to introduce another current of high pressure air via a third air duct and a secondary serpentine hose into a bottom portion of an oil tank to blow up iron filings and slurry at the bottom of the oil tank to facilitate discharge of the same via a screw hole at the bottom of the oil tank.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
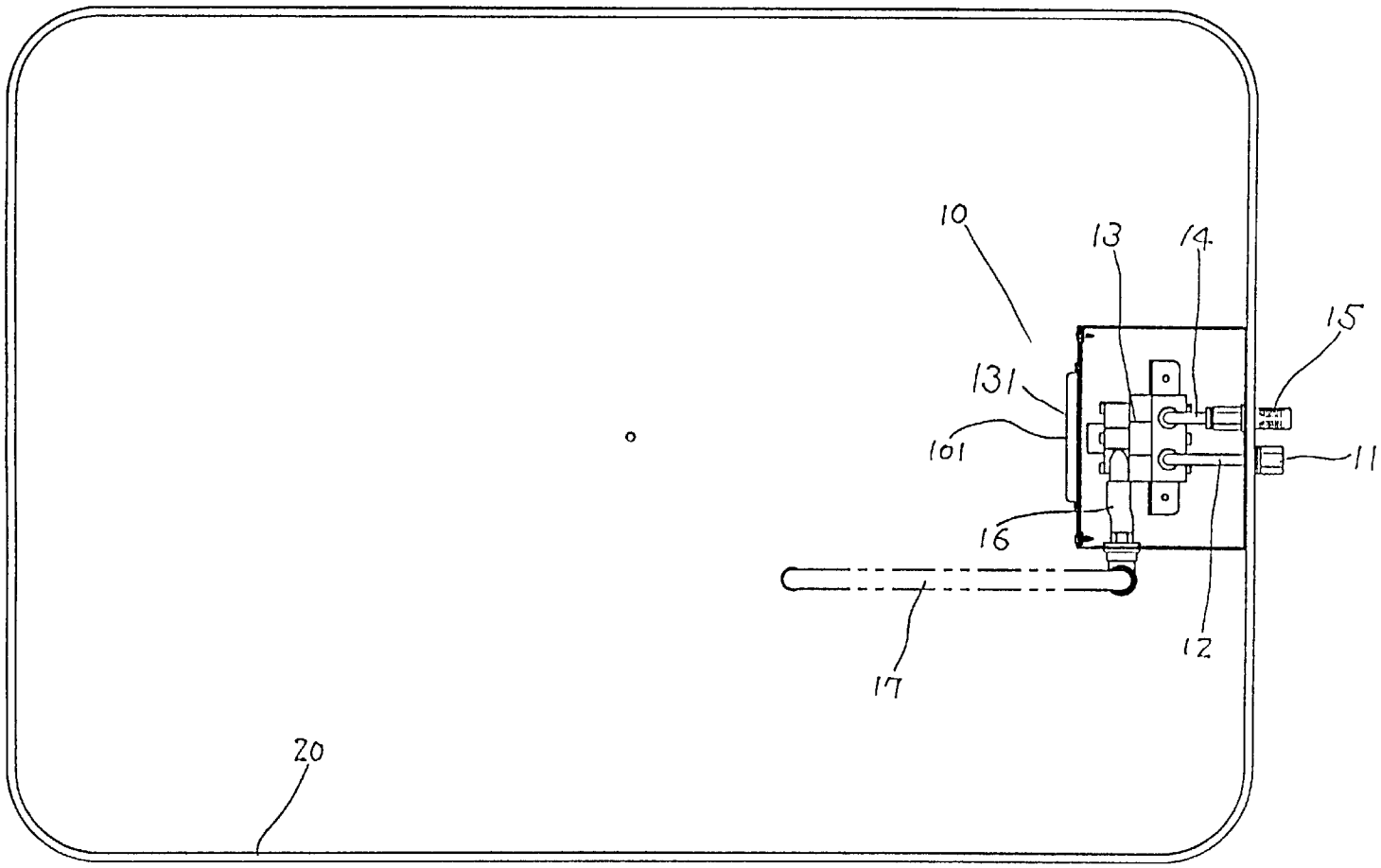
FIG. 1 (PRIOR ART)
FIG. 1 is an assembled plan view of the prior art.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
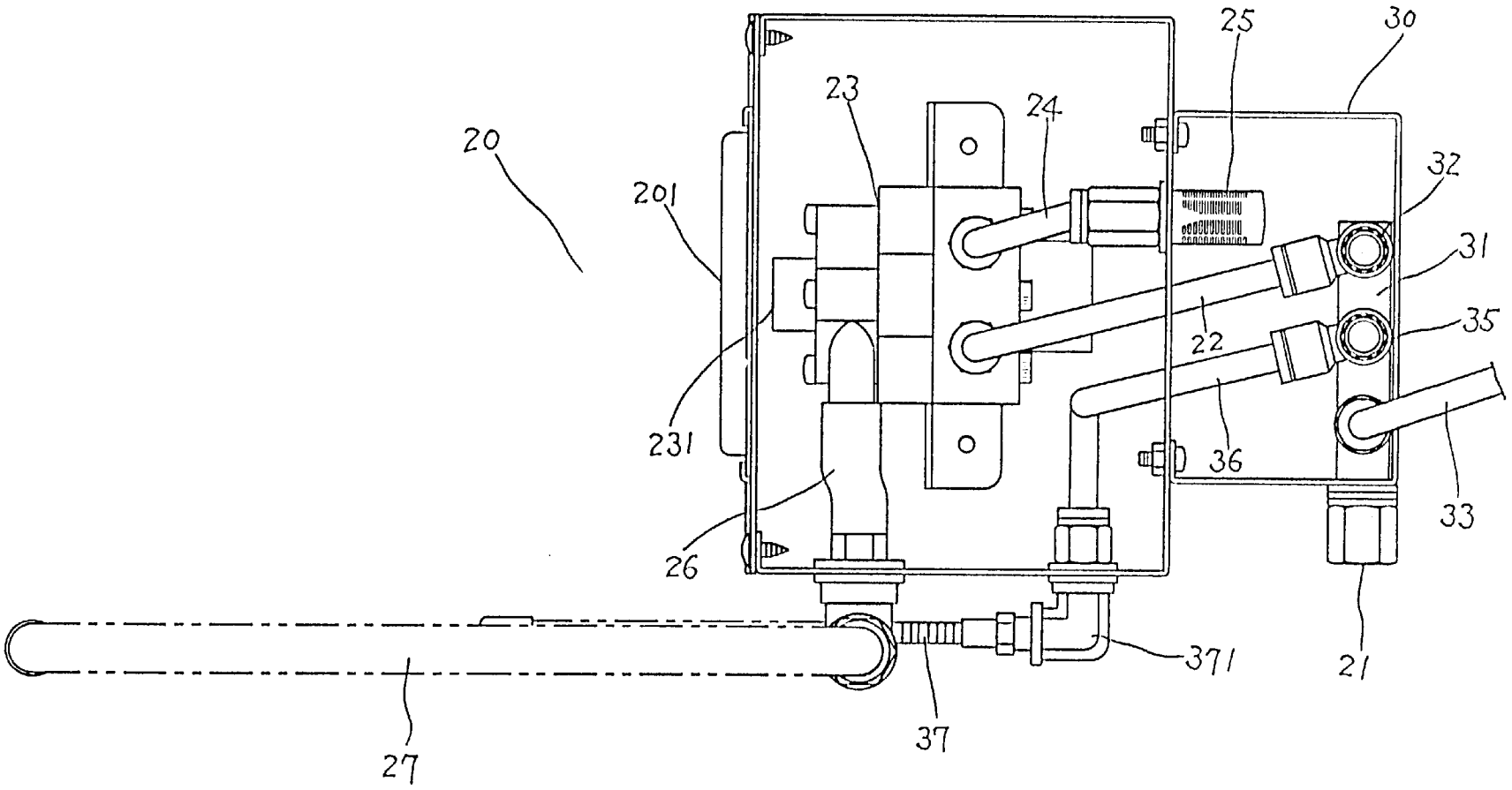
FIG. 2 is an assembled plan view of a detergent recycling apparatus according to the present invention.
Figure 3:
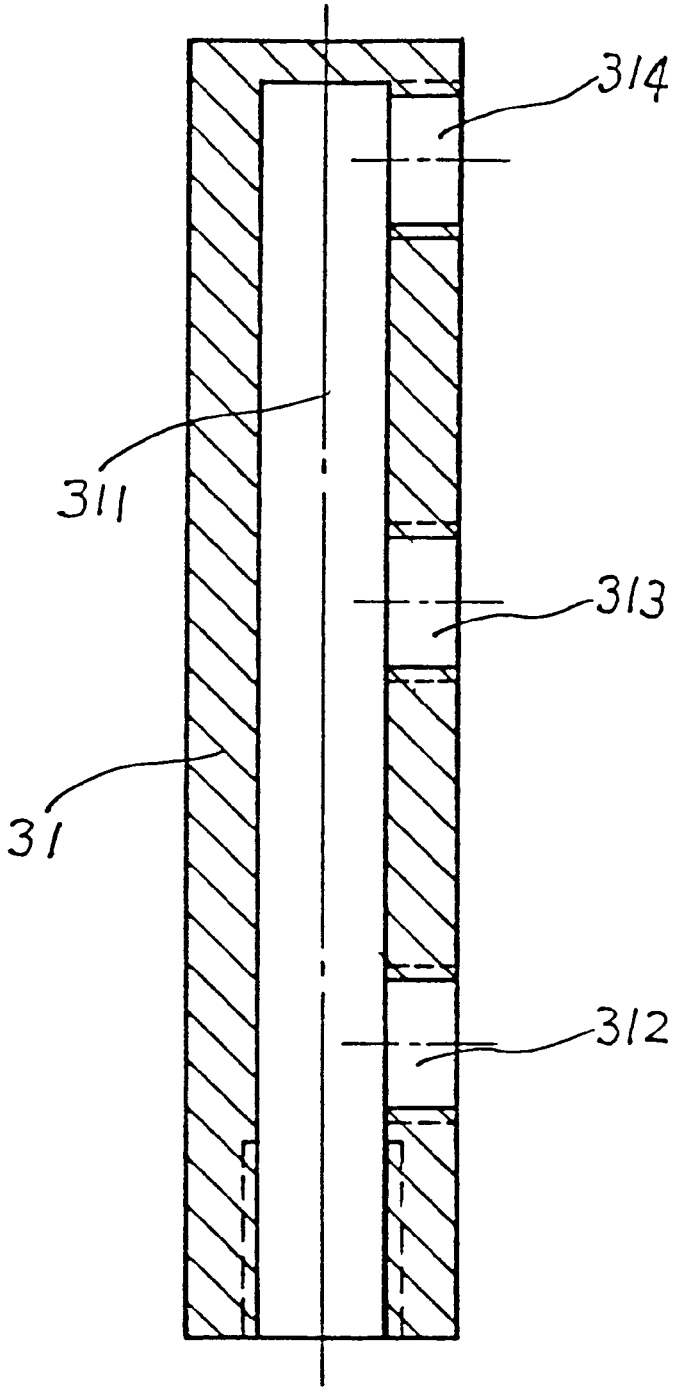
FIG. 3 is an enlarged sectional view of a manifold according to the present invention.
Figure 4:
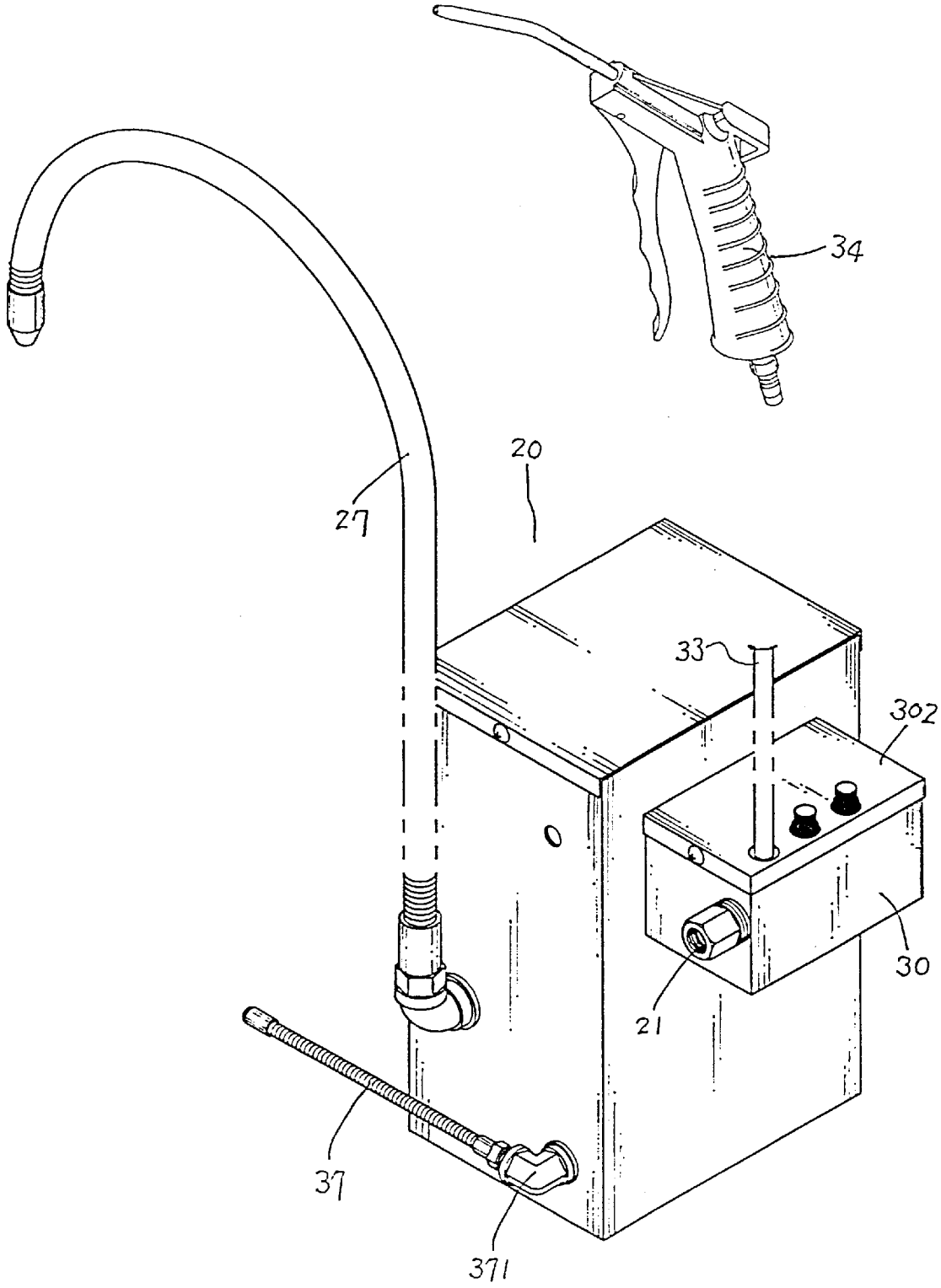
FIG. 4 is a right side perspective view of the present invention.
Figure 5:
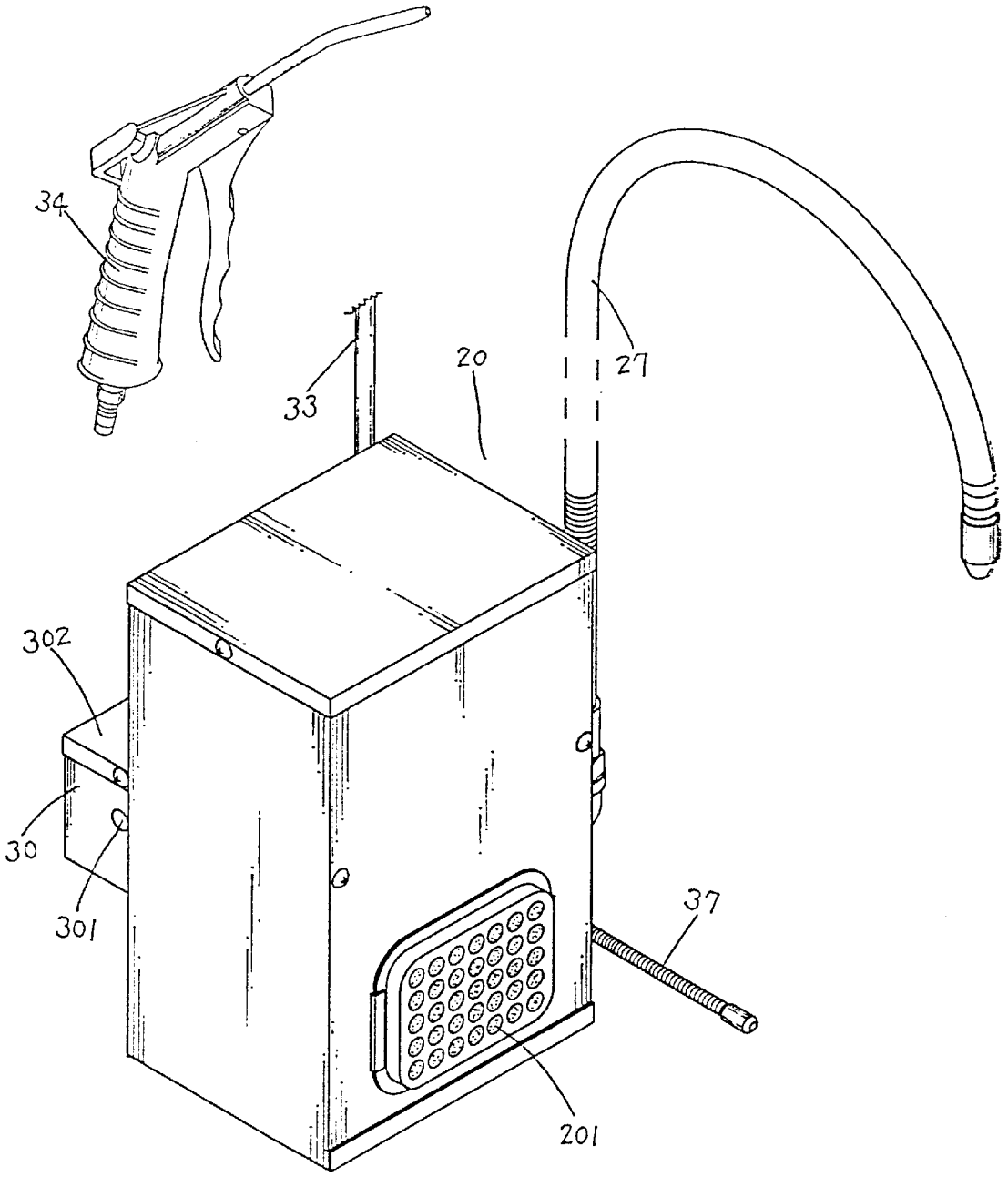
FIG. 5 is a left side perspective view of the present invention.
Figure 6:
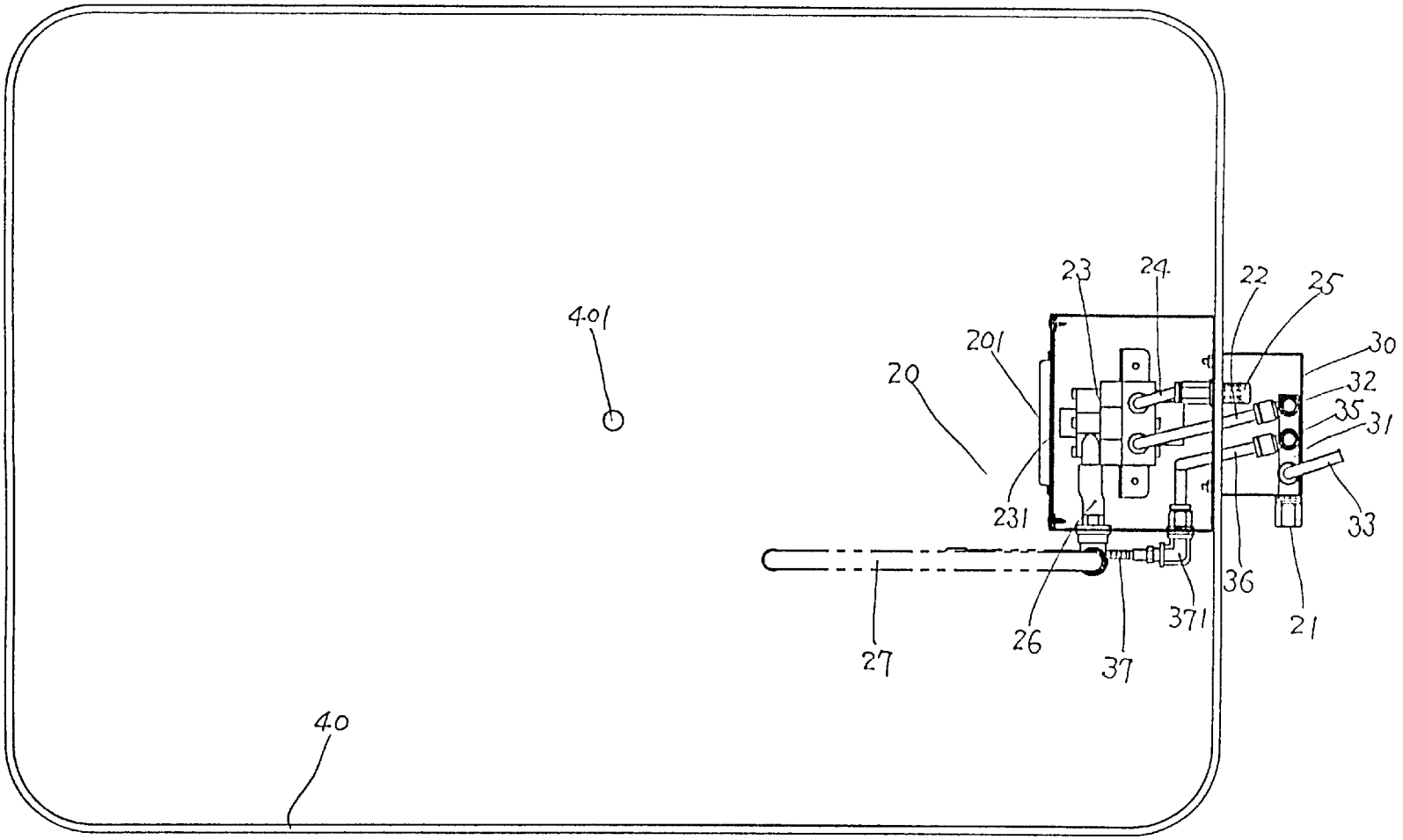
FIG. 6 is an assembled plan view of the present invention in use.

With reference to FIGS. 2 to 6, an improved detergent recycling apparatus for parts washing machines according to the present invention comprises, in addition to the conventional components including a high pressure air inlet 21, a first air duct 22, an extraction pump 23, a second air duct 24, a silence 25, a filter mesh 201, an oil duct 26 and a primary serpentine hose 27, a control box 30, a manifold 31, a first control valve 32, an extension tube 33, a spray gun 34, a second control valve 35, a third air duct 36, a secondary serpentine hose 37. The arrangement and operating principle of the conventional components are described hereinafter.

A detergent recycling apparatus is installed in an oil tank 40 immersed in a cleaning solution, and the high-pressure air inlet 21 introduces thereinto high-pressure air. The first air duct 22 transports the high-pressure air to the extraction pump 23to drive vacuum vanes to rotate. The second air duct 24 leads air from the silencer 25 via an outlet 301 to be discharged. When the vacuum vanes in the extraction pump 23 rotate, the drawing force thus generated causes the cleaning solution to pass the filter mesh 201 and to be sucked via a suction port 231 of the extraction pump 23. Then the cleaning solution is transported via the oil duct 26 to the primary serpentine hose 27 and flows out for washing impurities and oil stain off processed parts. The cleaning solution is then recycled back into the oil tank 40 for the next operation.

The arrangement of the control box 30, manifold 31, first control valve 32, extension tube 33, spray gun 34, second control valve 35, third air duct 36, and secondary serpentine hose 37 are described hereinafter.

The control box 30 is an enclosed type box having a top cover 302 and is mounted at one side of the detergent recycling apparatus. The control box 30 accommodating therein the manifold 31, first control valve 32, silencer 35, extension tube 33 and second control valve 35.

The manifold 31 is an elongated tube and is formed with an air vent 311 internally. The high-pressure air inlet 21 is at one end of the manifold. Three threaded holes 312, 313, 314 are formed on an axial surface of the manifold 31 passing through the air vent 311. The extension tube 33, second control valve 35 and first control valve 32 are respectively screwably secured at the three threaded holes.

The first control valve 32 is fixedly provided at the rear threaded hole 314 of the manifold 31 and communicates with the extraction pump 23 via the first air duct 22.

The extension tube 33 is screwably locked at the front threaded hole 312 of the manifold 31 on one end and the spray gun 34 on the other.

The second control valve 35 is screwably locked to the intermediate threaded hole 313 of the manifold 31 and connected to the secondary serpentine hose 37 via the third air duct 36.

The secondary serpentine hose 37 has a bent connector 371 mounted at a bottom portion on an outer side of the detergent recycling apparatus 20.

In use, high pressure air induced via the high pressure air inlet 21 is conducted via the extension tube 33 to the spray gun 34 for blowing off residual cleaning solution on the washed parts so as to achieve optimum washing effects. In addition, the second control valve 35 may control to have another current of high pressure air into the secondary serpentine hose 37 via the third air duct 36 and further into the oil tank 40 near its bottom portion to blow the cleaning solution and iron filings and slurry out through a screw hole 401 at the bottom portion of the oil tank 40 when the oil tank 40 is being cleaned up.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A detergent recycling apparatus for parts washing machine, said detergent recycling apparatus being installed in an oil tank immersed in a cleaning solution, high pressure air being induced via a high pressure air inlet and transported via a first air duct to an extraction pump to drive vacuum vanes therein to rotate, a second air duct being utilized to lead the air to a silencer and out via an outlet, a drawing force being generated when said vacuum vanes inside said extraction pump rotate so as to suck in a cleaning solution from a filter mesh and a suction port of said extraction pump, the cleaning solution being further transported by an oil tube to a primary serpentine hose, the cleaning solution flowing out of said primary serpentine hose being used to wash off impurities and oil stain on processed metal parts, said cleaning solution being recycled back into said oil tank, wherein:

said detergent recycling apparatus further comprises a control box, a manifold, a first control valve, an extension tube, a spray gun, a second control valve, a third air duct, and a secondary serpentine hose, said control box being an enclosed box having a top cover mounted on one side of said detergent recycling apparatus, said manifold, said first control valve, said silencer, said extension tube and said second control valve being assembled to said control box;

said manifold being internally provided with an air vent and having said high pressure air inlet at one end thereof, said manifold including front, intermediate and rear threaded holes provided on an axial surface thereof and communicating with said air vent;

said first control valve being screwably secured to said rear threaded hole of said manifold and communicating with said extraction pump via said first air duct;

said extension tube being screwably locked to the position of said front threaded hole of said manifold at one end and connected to said spray gun at the other;

said second control valve being locked to said intermediate threaded hole of said manifold and connected to said secondary serpentine hose via said third air duct; and said secondary serpentine hose having a bent connector mounted at an outer side of said detergent recycling apparatus near a bottom portion thereof;

whereby high pressure air enters via said high pressure air inlet through said extension tube to said spray gun to blow off residual cleaning solution on the washed parts to achieve optimum washing effects, and said second control valve controls another current of high pressure air via said third air duct and said secondary serpentine hose into the bottom portion of said oil tank so as to blow up the cleaning solution and iron filings and slurry deposited on the bottom portion of said oil tank to facilitate discharge thereof through a screw hole at the bottom portion of said oil tank.

* * * * *